United States Patent [19]

Katoh

[11] Patent Number: 4,701,400

[45] Date of Patent: Oct. 20, 1987

[54] SILVER SALT DIFFUSION TRANSFER PHOTOGRAPHIC ELEMENT WITH CATIONIC POLYMER

[75] Inventor: Kazunobu Katoh, Kanagawa, Japan

[73] Assignee: Fuji Photo Film Co., Ltd., Kanagawa, Japan

[21] Appl. No.: 871,358

[22] Filed: Jun. 6, 1986

[30] Foreign Application Priority Data

Jun. 7, 1985 [JP] Japan ..... 60-123864

[51] Int. Cl.[4] ..... G03C 5/54

[52] U.S. Cl. ..... 430/233; 430/213; 430/227; 430/941

[58] Field of Search ..... 430/233, 227, 213, 248

[56] References Cited

U.S. PATENT DOCUMENTS 3,174,858 3/1965 van Hoof et al. ..... 430/232
3,619,186 11/1971 Patsons ..... 430/233
4,288,522 9/1981 Carael et al. ..... 430/233
4,520,096 5/1985 Endo et al. ..... 430/233
4,585,725 4/1986 Sakaguchi ..... 430/233

OTHER PUBLICATIONS

Kotah et al., allowed U.S. application Ser. No. 821,198, filed 1/22/86.

*Primary Examiner*—Richard L. Schilling
*Attorney, Agent, or Firm*—Sughrue, Mion, Zinn, Macpeak & Seas

[57] ABSTRACT

A silver salt diffusion transfer photographic element is disclosed, comprising a support, an image-receiving layer containing at least a silver-precipitating nucleus provided on the support, and a layer containing cellulose acetate having a degree of acetylation of 40 to 49% and a cationic polymer electrolyte sandwiched between the support and the image-receiving layer.

12 Claims, No Drawings

SILVER SALT DIFFUSION TRANSFER PHOTOGRAPHIC ELEMENT WITH CATIONIC POLYMER

FIELD OF THE INVENTION

The present invention relates to a silver salt diffusion transfer photographic element, i.e., a photographic element for use in the silver salt diffusion transfer method, and more particularly, to an image-receiving element for use in the silver salt diffusion transfer method.

BACKGROUND OF THE INVENTION

The diffusion transfer photographic method utilizing silver salts, such as silver halide, is well known. In one technique for practicing such a photographic method, a light-sensitive element containing an exposed silver halide photographic emulsion and an image-receiving element containing silver-precipitating nuclei are superposed, and then an alkaline processing solution containing a silver halide solvent is introduced in between the above two elements to process them in the presence of a developing agent, thereby forming a positive silver image directly on the image-receiving element.

In the above method, the portion of the silver halide emulsion which, after exposure, remains unexposed in the light-sensitive element is dissolved by the silver halide solvent and eluted in the alkaline processing solution as a silver ion complex. This silver ion complex is transferred to the image-receiving element and precipitates therein as a silver image under the action of silver-precipitating nuclei. In this way, a positive image is formed directly on the image-receiving element.

In this method, however, a problem arises in that the silver image formed in the image-receiving element is liable to discolor or fade during its storage.

In order to overcome the above problem, Japanese Patent Publication No. 5392/71, U.S. Pat. No. 3,533,789 and British Pat. No. 1,164,642 disclose a method in which the surface of the silver image is coated with a water-soluble polymer solution containing an alkali-neutralizing component. This method, however, has disadvantages in that it takes a considerably long time for the surface coated with the aqueous polymer solution to become completely dry; since the surface is sticky and adhesive until it becomes completely dry, a print cannot be superposed thereon and finger prints or dust often attach thereto. This method also has the disadvantage that it is troublesome to further coat the silver image with such a solution.

Japanese Patent Publication No. 44418/81 discloses an image-receiving element comprising a support and the following layers: (1) a cellulose ester, polyvinyl ester or polyvinyl acetal layer which contains a compound capable of diffusing and altering properties of a silver image and is hydrolyzable, and upon hydrolysis, becomes permeable to an alkali, and (2) a regenerated cellulose layer containing silver-precipitating nuclei. As compounds capable of diffusing and altering the properties of a silver image, organic mercapto compounds are described.

Furthermore, Japanese Patent Publication No. 21140/81 and International patent application WO No. 2332/80 disclose a method of preventing the fading of a silver image by causing noble metal compounds to act on the silver image.

It has been found, however, that the organic mercapto compounds and noble metal compounds cause various problems such as staining and adverse influences on the image-forming speed because they must be added in a large amount for the protection of a silver image.

Under such circumstances, an improved photographic element for the silver salt diffusion transfer method, using a silver halide emulsion layer containing at least silver iodide as a light-sensitive layer has been proposed (U.S. patent application Ser. No. 821,198, filed Jan. 22, 1986, which corresponds to Japanese Patent Application No. 9344/85), in which the image-receiving element is provided with an iodine ion-capturing layer which is sandwiched between a support and an image-receiving layer on the support, the image-receiving layer contains silver-precipitating nuclei.

In practice, however, it has been found that several problems are encountered in incorporating the iodine ion-capturing layer. One of the problems is that the adhesion between adjacent layers is poor and the layers readily separate from each other. Another unexpected problem is that the coating is poor in flexibility; when cut or bent, the coating readily cracks.

SUMMARY OF THE INVENTION

An object of the present invention is to provide a novel diffusion transfer photographic element or photographic element for the diffusion transfer method, particularly an image-receiving element of the photographic element.

Another object of the present invention is to provide a photographic element for formation of a stabilized silver image by the diffusion transfer method.

Still another object of the present invention is to provide an image-receiving element which is improved in film strength.

Still another object of the present invention is to provide an image-receiving element containing cellulose acetate and a cationic polymer electrolyte, which is excellent in stability against a coating solution.

It has been found that the objects are attained by sandwiching a layer containing cellulose acetate having a degree of acetylation of 40 to 49% and a cationic polymer electrolyte between a support and an image-receiving layer containing at least silver-precipitating nuclei provided on the support.

Thus, the present invention provides a silver salt diffusion transfer photographic element comprising a support and an image-receiving layer containing at least silver-precipitating nuclei provided on the support, wherein a layer containing cellulose acetate having a degree of acetylation of 40 to 49% and a cationic polymer electrolyte is sandwiched between the support and the image-receiving layer.

DETAILED DESCRIPTION OF THE INVENTION

Various known quaternary ammonium or phosphonium salt polymers can be used as the cationic polymer electrolytes of the present invention. These quaternary ammonium salt or phosphonium salt polymers are known as mordant polymers or antistatic agent polymers and are described in the literature. Typical examples are as follows:

Water dispersion latexes as described in Japanese patent application (OPI) No. 166940/84 (the term "OPI" as used herein refers to a "published unexamined Japanese patent application"), U.S. Pat. No. 3,958,995, Japanese patent application (OPI) Nos. 142339/80, 126027/79, 155835/79, 30328/78, and 92274/79; polyvinyl pyridinium salts as described in U.S. Pat. Nos. 2,548,564, 3,148,061 and 3,756,814; water-soluble quaternary ammonium salt polymers as described in U.S. Pat. No. 3,709,690; and water-insoluble quaternary ammonium salt polymers as described in U.S. Pat. No. 3,898,088.

Preferred cationic polymer electrolytes are compounds represented by the following general formula (I):

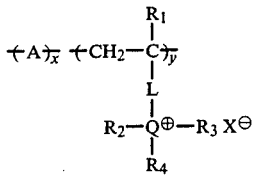

(I)

In the general formula (I), A represents an ethylenically unsaturated monomer unit.

$R_1$ represents a hydrogen atom or a lower alkyl group having about 1 to 6 carbon atoms.

L represents a divalent group having about 1 to 12 carbon atoms.

$R_2$, $R_3$ and $R_4$ may be the same or different and are each an alkyl group having about 1 to 20 carbon atoms or an aralkyl group having about 7 to 20 carbon atoms. $R_2$, $R_3$ and $R_4$ may combine together to form a ring structure in combination with Q.

Q is N or P.

$X^{\ominus}$ represents an anion other than an iodine ion.

x is 0 to about 90 mol%, and y is about 10 to 100 mol%.

Examples of the ethylenically unsaturated monomers represented by A are olefins (e.g., ethylene, propylene, 1-butene, vinyl chloride, vinylidene chloride, isobutene and vinyl bromide), dienes (e.g., butadiene, isoprene and chloroprene), fatty acid or aromatic carboxylic acid ethylenically unsaturated esters (e.g., vinyl acetate, allyl acetate, vinyl propionate, vinyl butylate and vinyl benzoate), ethylenically unsaturated acid esters (e.g., methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, dibutyl maleate, diethyl fumarate, ethyl crotonate and dibutyl methylenemalonate), styrenes (e.g., styrene, α-methylstyrene, vinyltoluene, chloromethylstyrene, chlorostyrene, dichlorostyrene and bromostyrene), and unsaturated nitriles (e.g., acrylonitrile, methacrylonitrile, allyl cyanide and crotonnitrile). Of these compounds, styrenes and methacrylic acid esters are particularly preferred in view of, e.g., their emulsion polymerizability and hydrophobic properties.

A may contain two or more of the above monomers.

$R_1$ is preferably a hydrogen atom or a methyl group in view of, e.g., their polymerizability.

L is preferably a divalent group represented

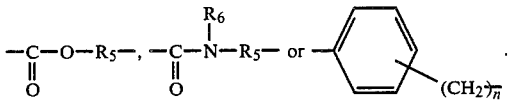

The groups of

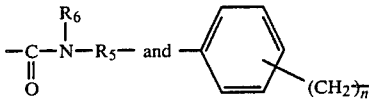

are more preferred because of, e.g., their fastness against alkalis. Particularly preferred is a group of

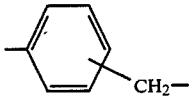

because of, e.g., its emulsion polymerization properties. In the above formulae, $R_5$ represents an alkylene group having preferably about 1 to 6 carbon atoms (e.g., methylene, ethylene, trimethylene and tetramethylene), an arylene group, or an aralkylene group (e.g.,

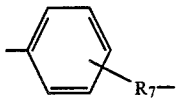

wherein $R_7$ is an alkylene group having about 1 to 6 carbon atoms). $R_6$ is a hydrogen atom or $R_2$. n is an integer of 1 or 2.

Q is preferably N because of, e.g., its ability to provide a lesser toxicity for the starting material.

$X^{\ominus}$ represents an anion other than iodine ion. Examples are halogen ions (e.g., a chlorine ion and a bromine ion), alkylsulfuric acid ions (the alkyl moiety in the alkylsulfuric acid has preferably about 1 to 6 carbon atoms, e.g., a methylsulfuric acid ion and an ethylsulfuric acid ion), alkyl- or arylsulfonic acid ions (the alkyl moiety in the alkylsulfonic acid has preferably about 1 to 6 carbon atoms, e.g., methane-sulfonic acid, ethanesulfonic acid, benzenesulfonic acid and p-toluenesulfonic acid), nitric acid ions, acetic acid ions and sulfuric acid ions. Of these ions, a chlorine ion, an alkylsulfuric acid ion, an arylsulfonic acid ion and a nitric acid ion are particularly preferred.

The alkyl group and aralkyl group represented by $R_2$, $R_3$ and $R_4$ include substituted alkyl groups and substituted aralkyl groups.

Typical examples of the unsubstituted alkyl group are a methyl group, an ethyl group, a propyl group, an isopropyl group, a tert-butyl group, a hexyl group, a cyclohexyl group, a 2-ethylhexyl group and a dodecyl group. Typical examples of the substituted alkyl group are an alkoxyalkyl group (e.g., a methoxymethyl group, a methoxybutyl group, an ethoxyethyl group, a butoxyethyl group and a vinyloxyethyl group), a cyanoalkyl group (e.g., a 2-cyanoethyl group and a 3-cyanopropyl group), a halogenated alkyl group (e.g., a 2-fluoroethyl group, a 2-chloroethyl group and a perfluoropropyl group), an alkoxycarbonylalkyl group (e.g., an ethoxycarbonylmethyl group), an allyl group, a 2-butenyl group and a propargyl group.

Typical examples of the unsubstituted aralkyl group are a benzyl group, a phenethyl group, a diphenylmethyl group and a naphthylmethyl group. Typical examples of the substituted aralkyl group are an alkylaralkyl group (e.g., a 4-methylbenzyl group, a 2,5-dimethylbenzyl group, a 4-isopropylbenzyl group and a 4-octylbenzyl group), an alkoxyaralkyl group (e.g., a 4-methoxybenzyl group, a 4-pentafluoropropenyloxybenzyl group and a 4-ethoxybenzyl group), a cyanoaralkyl group (e.g., a 4-cyanobenzyl group and a 4-(4-cyanophenyl)benzyl group), and a halogenated aralkyl group (e.g., a 4-chlorobenzyl group, a 3-chlorobenzyl group, a 4-bromobenzyl group and a 4-(4-chlorophenyl)benzyl group).

The number of carbon atoms of the alkyl group represented by $R_2$, $R_3$ or $R_4$ is preferably 1 to 12, and the number of carbon atoms of the aralkyl group is preferably 7 to 14.

Examples of the ring structures formed by linking of $R_2$, $R_3$ and $R_4$ to each other in combination with Q are shown below.

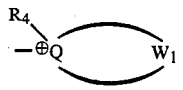

wherein $W_1$ represents an atomic group necessary for forming an aliphatic heterocyclic ring in combination with Q, the ring may have one or more substituents, such as a lower alkyl group.

Examples of the aliphatic heterocyclic rings are as follows.

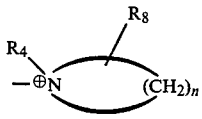

wherein $R_8$ represents a hydrogen atom or $R_4$, and n is an integer of 2 to 12.

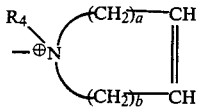

wherein a+b=an integer of 2 to 7.

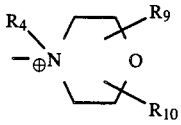

wherein $R_9$ and $R_{10}$ each represents a hydrogen atom or a lower alkyl group having 1 to 6 carbon atoms.

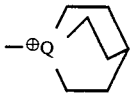

In addition, the following can be listed.

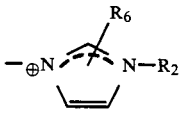

-continued

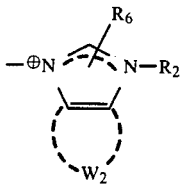

wherein $W_2$ represents an atomic group necessary for forming a benzene ring, the benzene ring may have one or more substituents, such as a lower alkyl group.

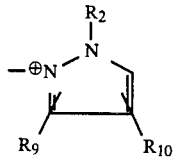

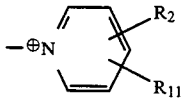

wherein $R_{11}$ represents a hydrogen atom,

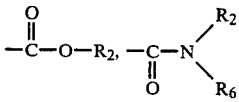

or $R_2$; when there are two $R_2$s, they may be the same or different. Of the above rings, the following are preferred.

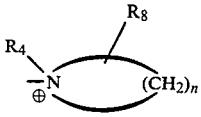

wherein n is an integer of 4 to 6

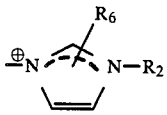

In the above examples, $R_2$, $R_4$, $R_6$, Q and $X^-$ are the same as defined in the general formula (I).

The cationic component represented by the formula:

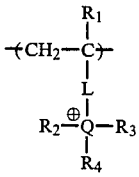

may be a mixture of two or more components.

x is preferably 20 to 60 mol %, and y is preferably 40 to 80 mol%.

It is particularly preferred for the cationic polymer electrolyte represented by the formula (I) to be copolymerized with a monomer having at least 2 (preferably 2 to 4) ethylenically unsaturated groups and to be used in the form of a cross-linked aqueous polymer latex in order that it does not exert photographically undesirable influences by migrating from the desired layer to another layer in the image-receiving element.

Copolymerizable monomers having at least two ethylenically unsaturated groups which can be used for the above purpose include ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylylenediammonium dichloride, N,N'-bis(vinylbenzyl)triethylenediammonium dichloride, and N,N,N',N'-tetrabutyl-N,N'-bis(vinylbenzyl)ethylenediammonium dichloride. Of these compounds, divinylbenzene and trivinylcyclohexane are particularly preferred from viewpoints of, e.g., hydrophobic properties and alkali resistance.

Typical examples of compounds represented by formula (I) are shown below. In the formulae, a, b and c represent a mol %.

I

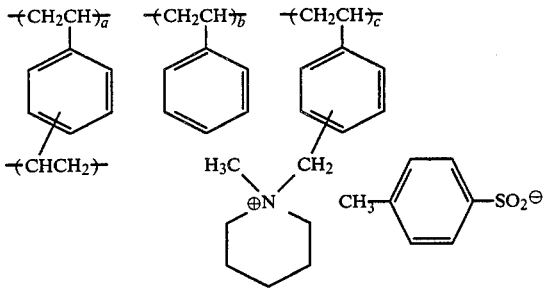

a:b:c = 5:47.5:47.5

II

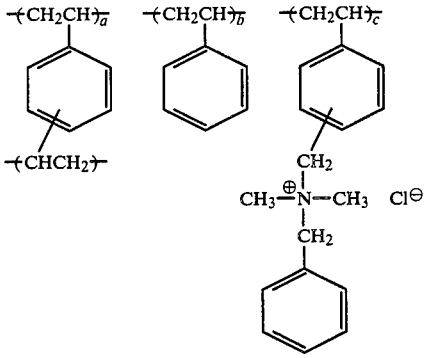

a:b:c = 10:45:45

III

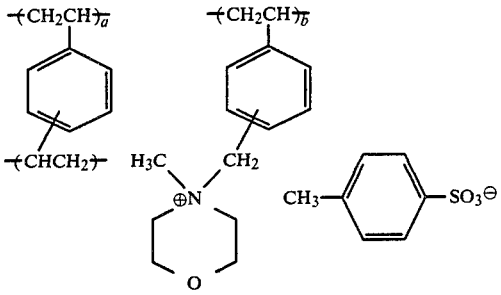

a:b = 5:95

IV

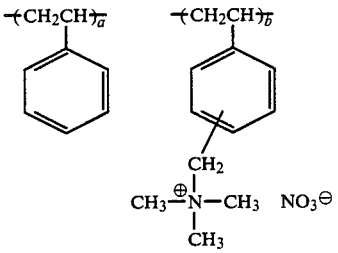

a:b = 50:50

V

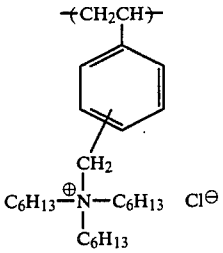

(MW is about 100,000)

VI

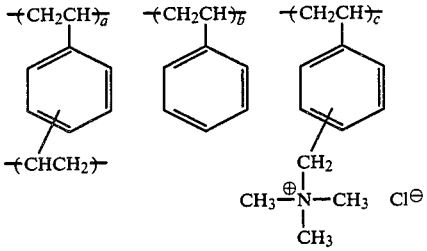

a:b:c = 10:45:45

The layer containing the cationic polymer electrolyte as described above is provided in a specific location of the image-receiving element. Preferably, when an alkali-neutralizing layer is used in combination with a neutral timing layer between an image-receiving layer and a support, the cationic polymer electrolyte layer is provided between the alkali-neutralizing layer and the neutral timing layer, or between the support and the alkali-neutralizing layer.

The cationic polymer electrolyte preferably has a molecular weight of about 10,000 to about 500,000.

The optimum amount of the cationic polymer electrolyte coated varies with the amount of iodine ion coated in the light-sensitive element. The amount of the cationic polymer electrolyte coated is usually 0.3 to 10 g/m$^2$ and preferably 0.5 to 4.0 g/m$^2$.

The degree of acetylation of cellulose acetate indicates the acetic acid content, i.e., the amount of acetic acid bound in cellulose acetate, which is expressed in terms of weight percentage. Properties of cellulose acetate, such as solubility in various solvents, transparency of a coating when coated, brittleness of the coating, adhesiveness between layers, and compatibility with other polymers, greatly vary depending on the degree of acetylation.

In the present invention, cellulose acetate having a degree of acetylation of 40 to 49% is used. If the degree of acetylation is too high, the effect of preventing the discoloration of the image is reduced. Furthermore, if the degree of acetylation is too high, the cellulose acetate cannot be uniformly mixed with the cationic polymer electrolyte, and causes phase separation and coagulation. On the other hand, if the degree of acetylation is too low, the cellulose acetate is sparingly soluble in water. In particular, the portion of cellulose acetate remaining undissolved produces an undesirable defect in forming a coating. Therefore, it is quite important to select a cellulose acetate having a degree of acetylation falling within the above defined range.

In connection with the amount of cellulose acetate mixed, the weight ratio of cellulose acetate to cationic polymer electrolyte is preferably 0.5:1 to 4.0:1. In a preferred embodiment, the mixture of the cellulose acetate and the cationic polymer electrolyte is dissolved in a mixed solvent of, e.g., acetone and water, acetone and diacetone alcohol, or acetone, diacetone alcohol and water, and coated. In addition, solvents such as methanol, ethanol, toluene, methyl acetate, methyl ethyl ketone, ethyl acetate, cellosolve, cellosolve acetate and methylene chloride can be used, if necessary. Furthermore, if necessary, various known additives such as a hardening agent, a plasticizer, a fluorescent whitener, a pigment, a coating aid and a wetting agent can be added. Coating and drying can be carried out by known techniques.

In the present invention, it is preferred to use, as a light-sensitive layer, a silver halide emulsion layer containing at least silver iodide.

The image-receiving element which is used in the present invention is usually prepared by the following method. First, a silver-precipitating nucleus selected from metal sulfides such as nickel sulfide, silver sulfide and palladium sulfide, and noble metal (e.g., gold, silver and palladium) colloids are dispersed in an alkali permeable polymer binder selected from gelatin, carboxymethyl cellulose, hydroxyethyl cellulose, regenerated cellulose, polyvinyl alcohol, sodium alginate, starch, gum arabic, colloidal silica and so forth, and the resulting dispersion is then coated on a paper support such as a baryta paper, a polyethylene-laminated paper, a lacquer paper or a synthetic paper, or a film support such as an acetyl cellulose film, a polyethylene terephthalate film or a polystyrene film.

Especially preferred is an image-receiving layer which is prepared using regenerated cellulose as a binder. It is known that such a layer can be prepared by the following various methods.

U.S. Pat. No. 3,179,517, for example, discloses a method of preparing an imge-receiving element which comprises subjecting an acetyl cellulose film to hydrolysis using an alkali to thereby form a regenerated cellulose layer, and then impregnating the regenerated cellulose layer in a gold salt solution and a reducing agent solution to allow them to react in the layer to form a gold-precipitating nucleus of gold colloid.

Japanese Patent Publication No. 32754/69 describes an image-receiving element which is prepared by incorporating a silver-precipitating nucleus in an alkali-impermeable polymer substance by vacuum deposition, dissolving the polymer in a solvent capable of dissolving the polymer, coating the resulting solution on a support, drying the coating thus formed, and then hydrolyzing the surface layer of the polymer layer to make the layer alkali-permeable.

Japanese Patent Publication No. 43944/71 describes a method of preparing an image-receiving element which comprises forming a silver-precipitating nucleus in a solution of acetyl cellulose, coating the solution on a support, and then hydrolyzing the acetyl cellulose to convert it to regenerated cellulose.

Japanese Patent Publication No. 49411/76 describes an image-receiving element which is prepared by hydrolyzing a cellulose ester layer and incorporating a silver-precipitating nucleus in the hydrolyzed layer simultaneously with the hydrolysis or after the hydrolysis.

U.S. Pat. No. 4,163,816 describes an image-receiving element which is prepared by hydrolyzing acetyl cellulose with an acid in a solution to convert it to regenerated cellulose having a lower degree of acetylation and then coating the solution on a support.

The diffusion transfer method is well known in the art and therefore its detailed explanation is omitted. For details, the following references can be referred to.

A. Rott and E. Weyde, *Photographic Silver Diffusion Transfer Processes,* Focal Press, London (1972), C. B. Neblette, *Handbook of Photography and Reprography,* Van Nostrand Reinhold, 7th Ed. (1977), Chapter 12, One-Step Photography, and Haist, *Modern Photographic Processing,* Vol. 2, Chapter 8, Diffusion Transfer.

Various types of photographic materials can be used in the diffusion transfer method. That is, it is known that a transferred silver image can be formed by placing a light-sensitive element comprising a support with a light-sensitive layer coated thereon, the light-sensitive layer containing a silver halide photographic emulsion, on an image-receiving element comprising a support with an image-receiving layer coated thereon, the image-receiving layer containing a silver-precipitating nucleus, and then introducing a processing element, i.e., an alkaline processing composition (e.g., a high or low viscosity alkaline processing composition containing a developing agent and a silver halide solvent) between the above two elements. In the practice of the present invention, this photographic material is advantageously used.

Another photographic material is as described in U.S. Pat. No. 2,861,885, in which a light-sensitive element and an image-receiving element are superposed and provided on a support, and a positive image can be observed through a negative image by utilizing a high covering power of the positive image.

Another photographic material is of the same structure as above, but in which, after the diffusion transfer processing, the layer of the light-sensitive material is removed by washing to obtain only a positive image.

Another photographic material is such that a silver halide light-sensitive layer, a layer containing a light-reflective substance such as titanium white, and an image-receiving layer containing a silver-precipitating agent are coated on a support in this order. Upon processing of the material, a positive image can be obtained.

Still another photographic material is known, which is of the laminated one body structure and, after the diffusion transfer processing, can be used without separating apart the light-sensitive element from the image-receiving element.

An additive image can be formed by forming a silver transferred image according to the present invention. This additive image is in a superposed relation with an additive screen. In such an embodiment, an additive color screen is placed between a transparent support and the above image-receiving layer and a silver halide emulsion is exposed to light through the screen whereupon an additive color image can be obtained.

These photographic materials are described in detail in the aforementioned references.

The light-sensitive element of the present invention carries a light-sensitive layer containing one or more silver halide emulsions on a support. The silver halide is particularly preferably a high sensitivity silver iodobromide (iodine content: 3 to 10 mol %). This silver halide is dispersed in a suitable protective colloid substance, such as gelatin, agar, albumin, casein, collodion, cellulose type substances (e.g., carboxymethyl cellulose), vinyl polymers (e.g., polyvinyl alcohol), or linear polyamides (e.g., polyhexamethyleneadipiamide). Emulsions suitable for the above purpose can be prepared by the methods described in P. Glafkides, *Chimie et Physique Photographique,* Paul Montel Co., Ltd. (1967), G. F. Duffin, *Photographic Emulsion Chemistry,* The Focal Press (1966), and V. L. Zelikman et al., *Making and Coating Photographic Emulsion,* The Focal Press (1964).

These silver halide emulsions can be subjected to chemical sensitization, spectral sensitization and supersensitization, if necessary. Usually, known additives such as an antifoggant, a hardening agent, a development accelerator, a surface active agent and an antistatic agent can be incorporated.

It is useful to provide a protective layer on the light-sensitive layer for the purpose of protecting the light-sensitive layer from physical damage. Furthermore, it is useful to add matting agent particles to the protective layer in order to improve surface slipping properties or adhesion.

As the processing element that is used in the present invention, various processing compositions can be used. The processing composition preferably contains a developing agent, a silver halide solvent and an alkali agent. Depending on the purpose, a developing agent and/or a silver halide solvent can be incorporated in the light-sensitive element and/or the image-receiving element.

Suitable silver halide developing agents include benzene derivatives which are substituted with at least two hydroxyl groups and/or amino groups in the ortho- or para-position of the benzene nucleus, such as hydroquinone, amidol, metol, glycine, p-aminophenol and pyrogallol; and hydroxylamines, particularly primary and secondary aliphatic and aromatic N-substituted or $\beta$-hydroxylamines. These compounds are soluble in aqueous alkalis and include compounds such as hydroxylamine, N-methylhydroxylamine, N-ethylhydroxylamine and the compounds described in U.S. Pat. No. 2,857,276 and N-alkoxyalkyl-substituted hydroxylamines as described in U.S. Pat. No. 3,293,034.

In addition, hydroxylamine derivatives having a tetrahydrofurfuryl group as described in Japanese Patent Application (OPI) No. 88521/74 can be used.

Aminoreductones as described in West German Patent Application (OLS) Nos. 2,009,054, 2,009,055 and 2,009,078, and heterocyclic aminoductones as described in U.S. Pat. No. 4,128,425 can be used.

Moreover, tetraalkylreductinic acid as described in U.S. Pat. No. 3,615,440 can be used.

The above developing agents can be used in combination with phenidone compounds, p-aminophenol compounds or ascorbic acid as auxiliary developing agents.

Suitable silver halide solvents include the usual fixing agents such as sodium thiosulfate, sodium thiocyanate, ammonium thiosulfate and compounds as described in the above reference, U.S. Pat. No. 2,543,181, and cyclic imide/nitrogen base combinations such as a combination of barbiturate or uracyl and ammonia or amine, and compounds as described in U.S. Pat. No. 2,857,274.

In addition, 1,1-bissulfonylalkane and its derivatives are known and can be used as silver halide solvents of the present invention.

The processing composition contains alkalis, preferably alkali metal hydroxides, such as sodium hydroxide and potassium hydroxide. In case the processing composition is applied in such a manner that it is extended between the light-sensitive element and the image-receiving element which are superposed on each other, it is preferred for the processing composition to contain a polymer film-forming agent, a thickening agent or a tackifier. Hydroxyethyl cellulose and sodium carboxymethyl cellulose are useful for the above purpose. These compounds are incorporated in the processing composition in an effective amount to provide a suitable viscosity according to the known principle of the diffusion transfer photographic method. The processing composition may further contain other auxiliary agents known in the silver salt diffusion transfer method, such as an antifoggant, a toning agent and a stabilizer.

In the image-receiving element of the present invention, as described above, an alkali-neutralizing layer may be provided. For this alkali-neutralizing layer, polyacids and the like as described in Japanese Patent Publication No. 33697/73, for example, can be used. In providing the alkali-neutralizing layer, it is desirable to provide a neutralization timing layer between the alkali-neutralizing layer and the image-receiving layer.

The neutralization timing layer can contain image stabilizers as decribed in, for example, Japanese Patent Publication No. 44418/81 and U.S. Pat. No. 4,520,096.

If necessary, another hydrophilic polymer layer may be provided between the image-receiving layer containing a silver-precipitating nucleus and the neutralization timing layer. Polymers which can be used in this hydrophilic polymer layer include gelatin, gelatin derivatives (e.g., phthalated gelatin), sugars (e.g., starch, galactomannan, gum arabic, hydroxyethyl cellulose, methyl cellulose, carboxymethyl cellulose, pullulan, and hydroxypropyl cellulose), hydrophilic synthetic polymers (e.g., polyacrylamide, polymethyl acrylamide, poly-N-vinylpyrrolidone and 2-hydroxyethyl methacrylate), and the like.

It is also effective to coat the image-receiving layer with a layer of a hydrophilic polymer such as carboxydimethyl cellulose, gelatin, gum arabic, a dimethylhydantoin-formaldehyde condensate, and cellulose acetate phthalate for the purpose of improving peeling properties of the processing solution. Such improved peeling properties means that the processing solution is completely removed from the surface of the image-receiving layer.

In order to increase whiteness, a fluorescent whitener can be added. Furthermore, to soften the coated polymer layer, it is effective to add a plasticizer.

Suitable examples of the silver-precipitating nuclei are heavy metals such as iron, lead, zinc, nickel, cadmium, tin, chromium, copper, cobalt, particularly nobel metals such as gold, silver, palladium and platinum. Other useful silver-precipitating nuclei are the sulfides and selenides of heavy metals, particularly the sulfides of mercury, copper, aluminum, zinc, cadmium, cobalt, nickel, silver, palladium, lead, antimony, bismuth, cerium and magnesium, and the selenides of lead, zinc, antimony and nickel.

As in the known technique, the silver-precipitating nucleus is present in a small amount, e.g., in an amount of about $1\times10^{-5}$ to $25\times10^{-5}$ mol/m$^2$. Usually the silver-precipitating nucleus is used in as small an amount as possible. The reason for this is that at higher concentrations an excess of silver is precipitated, or an undesirable density in the background in a highlight region is produced. A mixed silver-precipitating agent can be used. As far as the presence of the silver-precipitating nucleus is concerned, it can be said that the image-receiving layer is substantially colorless or substantially transparent.

The photographic element, particularly the image-receiving element of the present invention, possesses a silver image stabilization effect, and particularly possesses a discoloration reducing effect. An image-receiving element excellent in strength as a film can be obtained by providing a layer containing cellulose acetate with a specific degree of acetylation and a cationic polymer electrolyte between a support and an image-receiving layer.

Furthermore, if a coating solution containing cellulose acetate having a specific degree of acetylation and a cationic polymer electrolyte is used, there can be obtained an effect that no phase separation occurs during the storage of the coating solution.

The present invention is described below in greater detail with reference to the following examples.

EXAMPLE 1

1. Preparation of Image-Receiving Sheet

The following layers were provided on a polyethylene laminated paper support in the numbered order. The figures in the parentheses indicate coated amounts and are expressed in g/m$^2$.

(1) Neutralizing Layer
- Cellulose acetate (degree of acetylation: 53%) (6)
- Methyl vinyl ether-maleic anhydride copolymer (4)
- Uvitex OB (trade name of a fluorescent dye, produced by Ciba Geigy Co.) (0.04)
- Titanium dioxide (0.5)

(2) Image Stabilization Layer
- Cellulose acetate (degree of acetylation: 46%) (4.2)
- Compound I (MW: about 80,000 ) (2.1)

(3) Neutralization Timing Layer
- Cellulose acetate (degree of acetylation: 55%) (5.0)
- 1-(4-Hexylcarbamoylphenyl)-2,3-dihydroimidazole-2-thione (0.06)

(4) Intermediate Layer
- Polyacrylamide (1.0)
- Formaldehyde (0.3)

(5) Image-Receiving Layer
- Regenerated cellulose (2.0)
- Palladium sulfide ($1.5\times10^{-3}$)
- 2-Mercaptobenzimidazole ($2.5\times10^{-3}$)

(6) Peeling Layer
- Butyl methacrylate-acrylic acid copolymer (molar ratio: 15:85) (0.03)

2. Preparation of Light-Sensitive Sheet

The following layers were provided on a black polyester film support in the numbered order. The figures in the parentheses also indicate coated amounts.

(1) Silver iodobromide having an average particle dimater of 1.0 μm (iodine content: 6.5 mol%) (silver amount: 0.59 g/m$^2$)
- Gelatin (3.5)

(2) Protective Layer
- Gelatin (0.7)
- Polymethyl methacrylate particles (0.1)

3. Processing Solution

| | |
|---|---|
| Potassium hydroxide (40 wt % aqueous KOH solution) | 323 ml |
| Titanium dioxide | 3 g |
| Hydroxyethyl cellulose | 79 g |
| Zinc oxide | 9.75 g |
| N,N—bismethoxyethylhydroxylamine | 75 g |
| Triethanolamine solution (4.5 wt parts of triethanolamine in 6.2 wt parts of water) | 17.14 g |
| Tetrahydropyrimidinethione | 0.4 g |
| 2,4-Dimercaptopyrimidine | 0.35 g |
| Uracyl | 80 g |
| Water | 1,193 g |

COMPARATIVE EXAMPLE 1

In place of the image stabilization layer of Example 1, the following composition was used.
- Gelatin (4.2)
- Compound I (2.1)

COMPARATIVE EXAMPLE 2

In place of the image stabilization layer of Example 1, the following composition was used.
- Cellulose acetate (degree of acetylation: 50.1%) (4.2)
- Compound I (2.1)

COMPARATIVE EXAMPLE 3

In place of the image stabilization layer of Example 1, the following composition was used.
- Polyvinyl alcohol (4.2)
- Compound I (2.1)

The light-sensitive sheet was exposed wedgewise by the use of a sensitometer with a light source having a color temperature of 5,400° K. This exposed light-sensitive sheet and the above image-receiving sheet were superposed, and the above processing solution was placed between the light-sensitive sheet and image-receiving sheet in a thickness of 0.035 mm to perform diffusion transfer development. After 30 seconds, 2 minutes or 10 minutes, they were separated from each other to form a positive print.

The positive print was subjected to a forced image deterioration test by allowing it to stand at 60° C. and 70% R.H. for 14 days.

In the images formed in the image-receiving sheets of Comparative Examples 1 and 3, and Example 1, almost no discoloration or fading was observed even when the light-sensitive sheet and the image-receiving sheet were separated after 10 minutes. However, in the image of Comparative Example 2, no change in image density occurred but discoloration to brown was observed when the light-sensitive sheet and the image-receiving sheet were separated after 1 minutes or 10 minutes.

The surface of the positive print was cut with a knife in a checked pattern, and an adhesive tape was bonded to the checked surface and peeled apart therefrom. It was examined how many squares were removed. In the sample of Comparative Example 1, the film was entirely removed. On the other hand, in the samples of Example 1 and Comparative Example 2, no damage was observed. In the sample of Comparative Example 3, about $\frac{1}{3}$ of the film was removed.

EXAMPLE 2

The stability of a coating solution was tested using cellulose acetate having a different degree of acetylation. The composition of the coating solution used was as follows.

| | |
|---|---|
| Cellulose acetate (degree of acetylation: 45%) | 34 g |
| Acetone | 300 ml |
| Water | 130 ml |
| Diacetone alcohol | 100 ml |
| Compound I (20 wt % aqueous dispersion) | 180 g |

The solution was stored at room temperature for 24 hours. No change was observed. On coating the solution, a uniform lustrous surface was obtained.

COMPARATIVE EXAMPLE 4

Example 2 was repeated using a cellulose acetate having a degree of acetylation of 50.1%, and the same test was conducted. On standing at room temperature for 24 hours, the solution caused phase separation. When the solution was coated, the coated surface was not uniform.

While the invention has been described in detail and with reference to specific embodiments thereof, it will be apparent to one skilled in the art that various changes and modifications can be made therein without departing from the spirit and scope thereof.

What is claimed is:

1. A silver salt diffusion transfer photographic element comprising a support and an image-receiving layer containing at least a silver-precipitating nucleus wherein a layer containing cellulose acetate having a degree of acetylation of 40 to 49% and a cationic polymer electrolyte is sandwiched between the support and the image-receiving layer.

2. The element according to claim 1, wherein the weight ratio of cellulose acetate to cationic polymer is from 0.5:1 to 4.0:1.

3. The element according to claim 1, wherein the cationic polymer electrolyte is a compound represented by the formula (I):

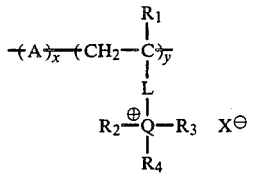

wherein

A represents an ethylenically unsaturated monomer unit, $R_1$ represents a hydrogen atom or a lower alkyl group having about 1 to 6 carbon atoms, L represents a divalent group having about 1 to 12 carbon atoms, $R_2$, $R_3$ and $R_4$ may be the same or different and are each an alkyl group having about 1 to 20 carbon atoms or an aralkyl group having about 7 to 20 carbon atoms, $R_2$, $R_3$ and $R_4$ may combine together to form a ring structure in combination with Q, Q represents N or P, $X^{\ominus}$ represents an anion other than an iodine ion, x is 0 to about 90 mol%, and y is about 10 to 100 mol%.

4. The element according to claim 3, wherein the ring formed by linking $R_2$, $R_3$ and $R_4$ in combination with Q is an aliphatic heterocyclic ring.

5. The element according to claim 3, wherein the ring formed by linking $R_2$, $R_3$ and $R_4$ in combination with Q is represented by the following formula:

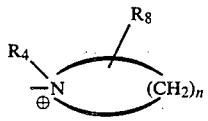

wherein $R_8$ represents a hydrogen atom or $R_4$, and n is an integer of 2 to 12,

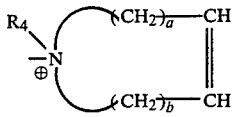

wherein a+b=an integer of 2 to 7,

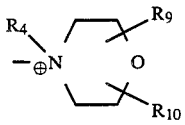

wherein $R_9$ and $R_{10}$ each represents a hydrogen atom or a lower alkyl group having 1 to 6 carbon atoms,

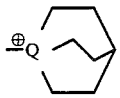

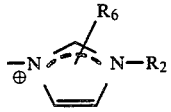

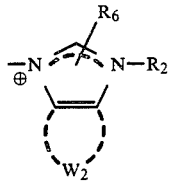

wherein $W_2$ represents an atomic group necessary for forming a benzene ring, and $R_6$ represents a hydrogen atom or $R_2$,

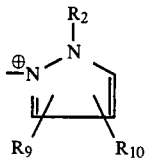

or

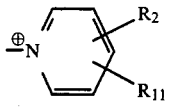

wherein $R_{11}$ represents a hydrogen atom,

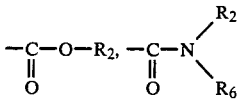

or $R_2$; when there are two $R_2$s, they may be the same or different.

6. The element according to claim 3, wherein x is about 20 to 60 mol% and y is about 40 to 80 mol%.

7. The element according to claim 3, wherein the cationic polymer electrolyte is represented by the following formula:

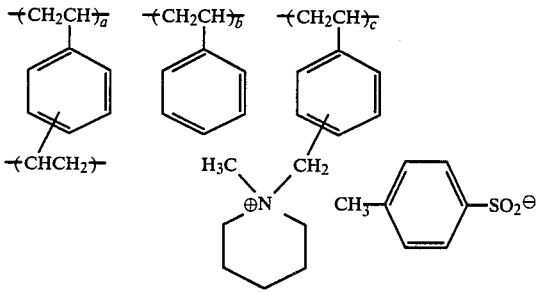

a:b:c = 5:47.5:47.5

(a, b and c represent a mol %, hereinafter the same)

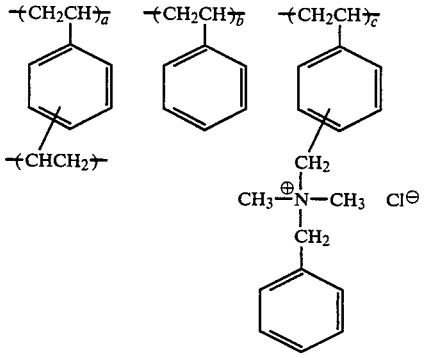

a:b:c = 10:45:45

-continued

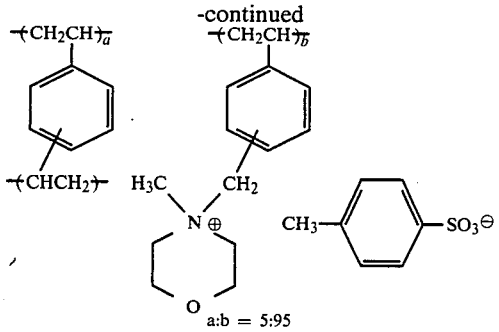

a:b = 5:95

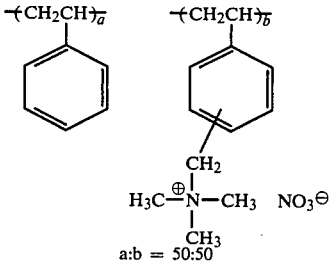

a:b = 50:50

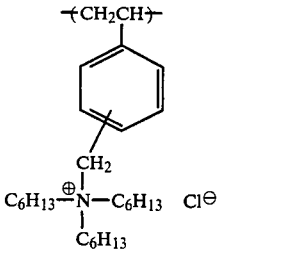

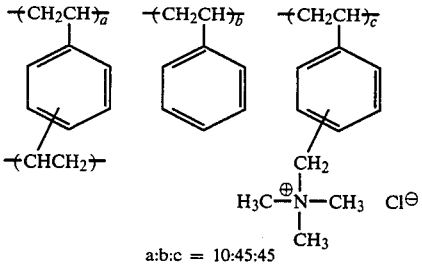

a:b:c = 10:45:45

8. The element according to claim 3, wherein the cationic polymer electrolyte is copolymerized with a monomer having at least two ethylenically unsaturated groups.

9. The element according to claim 8, wherein the monomer having at least two ethylenically unsaturated group is a compound selected from the group consisting of ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol dacrylate, tetramethylene glycol diacrylate, trimethylolpropane triacrylate, allyl methacrylate, allyl acrylate, diallyl phthalate, methylenebisacrylamide, methylenebismethacrylamide, trivinylcyclohexane, divinylbenzene, N,N-bis(vinylbenzyl)-N,N-dimethylammonium chloride, N,N-diethyl-N-(methacryloyloxyethyl)-N-(vinylbenzyl)ammonium chloride, N,N,N',N'-tetraethyl-N,N'-bis(vinylbenzyl)-p-xylylenediammonium dichloride, N,N'-bis(vinylbenzyl)triethylenediammonium dichloride, and N,N,N',N'-tetrabutyl-N,N'-bis(vinylbenzyl)ethylenediammonium dichloride.

10. The element according to claim 1, wherein the cationic polymer electrolyte is provided between an alkali neutralizing layer and a neutral timing layer.

11. The element according to claim 1, wherein the cationic polymer electrolyte is provided between the support and an alkali neutralizing layer.

12. The element according to claim 1, wherein the cationic polymer electrolyte is present in an amount of 0.3 to 10 g/m$^2$.

* * * * *